US007666483B2

(12) United States Patent
Barthelmess

(10) Patent No.: US 7,666,483 B2
(45) Date of Patent: Feb. 23, 2010

(54) PATIO PALM TREE

(75) Inventor: Peter Barthelmess, Whittier, CA (US)

(73) Assignee: Barcana, Inc., Cerritos, CA (US)

( * ) Notice: Subject to any disclaimer, the term of this patent is extended or adjusted under 35 U.S.C. 154(b) by 0 days.

(21) Appl. No.: 11/208,804

(22) Filed: Aug. 22, 2005

(65) Prior Publication Data

US 2007/0041179 A1 Feb. 22, 2007

(51) Int. Cl.
*A47G 33/06* (2006.01)
*A47B 37/00* (2006.01)

(52) U.S. Cl. ..... 428/19; 428/20; 428/18; 211/196; 211/205; 108/50.12; 362/123; 362/806

(58) Field of Classification Search ..... 428/18, 428/19, 20; 156/61; 211/196, 205; 362/123, 362/567; 446/73
See application file for complete search history.

(56) References Cited

U.S. PATENT DOCUMENTS

| | | | | |
|---|---|---|---|---|
| 1,943,659 | A | 1/1934 | Eason | |
| 2,760,052 | A | 8/1956 | Owen | |
| 4,462,065 | A | 7/1984 | Rhodes | |
| 4,734,301 | A | 3/1988 | McKinney | |
| 4,774,113 | A * | 9/1988 | Shaffer | 428/18 |
| D336,557 | S | 6/1993 | Wade | |
| 5,848,712 | A * | 12/1998 | Weir | 211/107 |
| 6,030,670 | A | 2/2000 | Chang | |
| 6,323,431 | B1 | 11/2001 | Lin | |
| 6,458,435 | B1 | 10/2002 | Lai | |
| 6,474,097 | B2 * | 11/2002 | Treppedi et al. | 62/457.7 |
| 6,527,413 | B1 | 3/2003 | McIngvale | |
| 6,596,353 | B1 * | 7/2003 | Turner | 428/18 |
| 6,869,198 | B1 | 3/2005 | Garza | |
| 2004/0149325 | A1 * | 8/2004 | Kuelbs | 135/20.3 |

FOREIGN PATENT DOCUMENTS

| | | | |
|---|---|---|---|
| AU | 700345 B | * | 1/1999 |
| JP | 07313230 A | * | 12/1995 |

* cited by examiner

*Primary Examiner*—John J. Zimmerman
*Assistant Examiner*—Aaron Austin
(74) *Attorney, Agent, or Firm*—Richard B. Klar

(57) ABSTRACT

An artificial palm tree assembly for insertion into a table, preferably a patio table, is provided. The artificial palm tree assembly comprises a palm head comprising a crown element and a plurality of tree elements attached to the crown element of the palm head. Each of the tree elements comprises a branch having a plurality of artificial palm tree leaves thereon. In addition, the artificial palm assembly further comprises a trunk element adapted for installation through an opening in the top of the table. The palm head connects to the trunk element via an attachment formed between a bottom area of the crown element and the top end of the trunk element. Moreover, artificial palm assembly preferably further comprises a base portion for providing support for the palm head and the trunk element of the palm tree assembly installed within the patio table.

18 Claims, 12 Drawing Sheets

PATIO PALM TREE

FIELD OF THE INVENTION

The present invention relates to artificial palm trees for being inserted within tables, such as patio tables.

BACKGROUND OF THE INVENTION

Artificial trees are known in the art. For Example, U.S. Pat. No. 6,869,198 B1 to Garza purports to disclose a portable artificial palm tree in a planter, with a plurality of artificial coconut lights to illuminate the portable palm tree in the planter. U.S. Pat. No. 6,458,435 B1 to Lai purports to disclose an artificial tree having a central trunk, a number of main branches suspended from an upper portion of the trunk in a downwardly and outwardly inclined orientation, and a preformed tree top section extending upwardly from the upper portion of the trunk. Means, such as electric lights are mentioned in Lai for illuminating the artificial tree. Further, U.S. Pat. No. 6,030,670 to Chang purports to disclose an artificial decorating tree with several hollow joints, sockets, connectors, branches, embellishing lamps and a set of electric cords. In Chang, the decorating tree is assembled with plug-in joints and internal wiring coupled to lamps supported from branches. Further, U.S. Pat. No. 4,734,301 to McKinney purports to disclose decorative artificial evergreen trees for use on festive winter occasions such as Christmas.

Despite the above advances in the artificial tree art, there still exists a need in the art for an artificial palm tree which inserts into an opening within a table such as patio table, thereby providing a decorative effect to the patio table and environment in which is the table is located, such as a patio deck, building lobby, etc. For example, due to their realistic look, these artificial palms within the patio table can create a pleasant tropical mood, both outdoors or indoors and even in the middle of winter. These artificial palms are also very easy to maintain, since there is no need to water them. Also, these artificial palms do not attract insects either and can exist in environments normally not conducive to palm trees.

SUMMARY OF THE INVENTION

In accordance with one aspect of the present invention, an artificial palm tree assembly for insertion into a table is provided. The artificial palm tree assembly comprises a palm head comprising a crown element and a plurality of tree elements attached to the crown element of the palm head. Each of the tree elements comprises a branch having a plurality of artificial palm tree leaves thereon. In addition, the artificial palm assembly further comprises a trunk element adapted for installation through an opening in the top of the table. The palm head connects to the trunk element via an attachment formed between a bottom area of the crown element and the top end of the trunk element.

In accordance with another aspect of the present invention, an artificial palm tree assembly and patio table set is provided. The artificial palm tree assembly and patio table set comprises a palm head comprising a crown element and a plurality of tree elements. The crown element comprises an outer shell, a bottom area and an inner tube located with the outer shell of the crown element. In addition, the tree elements are wrapped around the outer shell of the crown element. Each of the tree elements comprise a branch comprising twisted metal wires with a plurality of artificial palm tree leaves thereon. The artificial palm tree assembly and patio table set further comprises a trunk element comprising one of the following: a metal pole, a plastic pole, a wooden pole, a hollowed out wooden tree trunk. Moreover, the trunk element is divided into at least an upper portion and a lower portion, with the upper portion of the trunk element having a top open end. The palm head is adapted to connect to the trunk element via the inner tube located within the outer shell of the crown element, extending through an opening in a bottom end of the crown element such that a bottom open end of the inner tube is able to slide onto a connection area within the top end of the trunk element. In addition the upper portion of the trunk element has a bottom end adapted for sliding onto an insert located within the top end of the lower portion of the trunk element for connecting the lower and upper portions to one another. Additionally, the artificial palm tree assembly and patio table set further comprises a base portion attached to the bottom end of the lower portion of the trunk element. The base portion is connected to the lower portion of the trunk element via an open bottom end portion of the lower portion of the trunk element being adapted for sliding onto an insert located within the top open end of the base portion, for connecting the lower and upper portions to one another. Moreover, the base portion is additionally secured to the lower portion of the trunk element by a plurality of base fasteners. The artificial palm tree assembly and patio table set further comprises a patio table having a table top supported by a plurality of legs, with the patio table top having an opening therein which is adapted to receive a portion of the trunk element there through. The patio table further comprises a pole fastener assembly connected thereto beneath the table top for securing the trunk element within the opening of the patio table.

In accordance with yet another aspect of the present invention, a method of installing an artificial palm tree assembly within an opening of a table for providing a decorative effect to a table is provided. The method comprises attaching a bottom area of a crown element of a palm head to a connection area within a top open end of a trunk element for connecting the palm head and trunk element to each other. The palm head comprises the crown element and a plurality of tree elements attached to crown element of the palm head. Each of the tree elements comprises a branch having a plurality of artificial palm tree leaves thereon. The method further comprises placing a bottom end of the trunk element through the opening within the table.

DETAILED DESCRIPTION OF THE PREFERRED EMBODIMENTS

Figure 1:
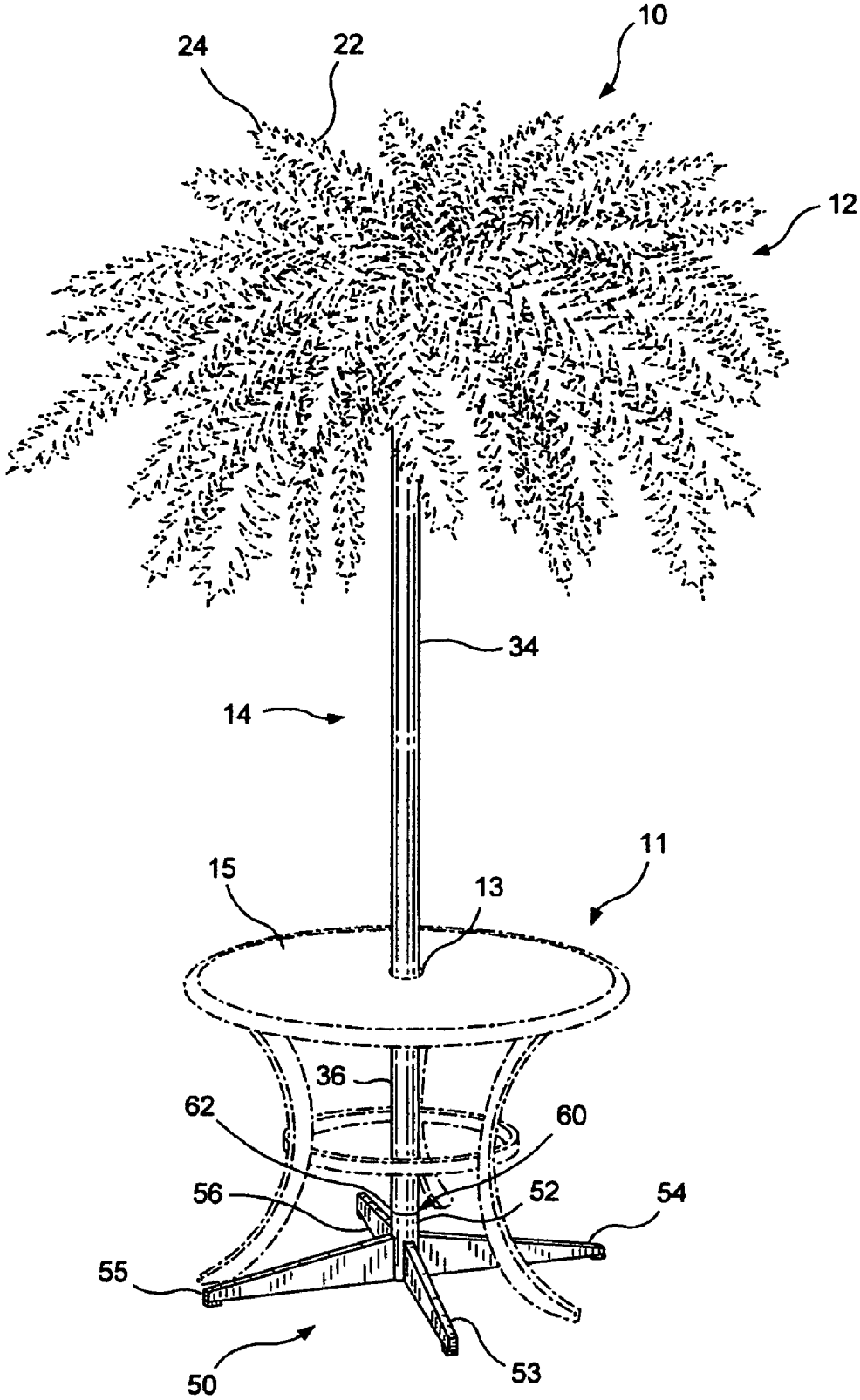
FIG. 1 is a perspective view of an artificial palm tree assembly of a first embodiment of the present invention installed within a patio table.

Referring to a first embodiment of the present invention shown in FIGS. 1-11, an artificial palm tree assembly 10 for a table 11, preferably a patio table is referred to generally at 10. The palm tree assembly 10 includes a palm head 12, a trunk element 14 and a base portion 16.

As shown in FIGS. 2-6, the palm head 12 comprises a crown element 18 and a plurality of artificial tree elements 20. Each artificial tree element 20 includes a branch 22 having artificial leaves 24 thereon. In this embodiment, each individual branch 22 is formed by a pair of twisted metal wires having the artificial leaves 24 connected or attached thereon. The artificial leaves 24 in this embodiment are artificial palm leaves made of polyvinyl chloride (PVC) material. However, other materials known in the art may also be used to form the artificial leaves 24. Moreover, the artificial leaves 24 rather than being all palm leaves may instead be a mixture of palm leaves and other types of artificial leaves, such as but not limited to a mixture of artificial palm leaves and artificial pine needles. For example, in some alternative embodiments, the mixture between the artificial palm leaves and artificial pine needles are in the ratio of about 70% artificial pine needles to about 30% artificial palm leaves. It is noted that the artificial tree elements 20, including the branches 22 and artificial leaves 24 are not limited to the above description but rather may be formed in any manner known in the artificial tree art.

Figure 6:
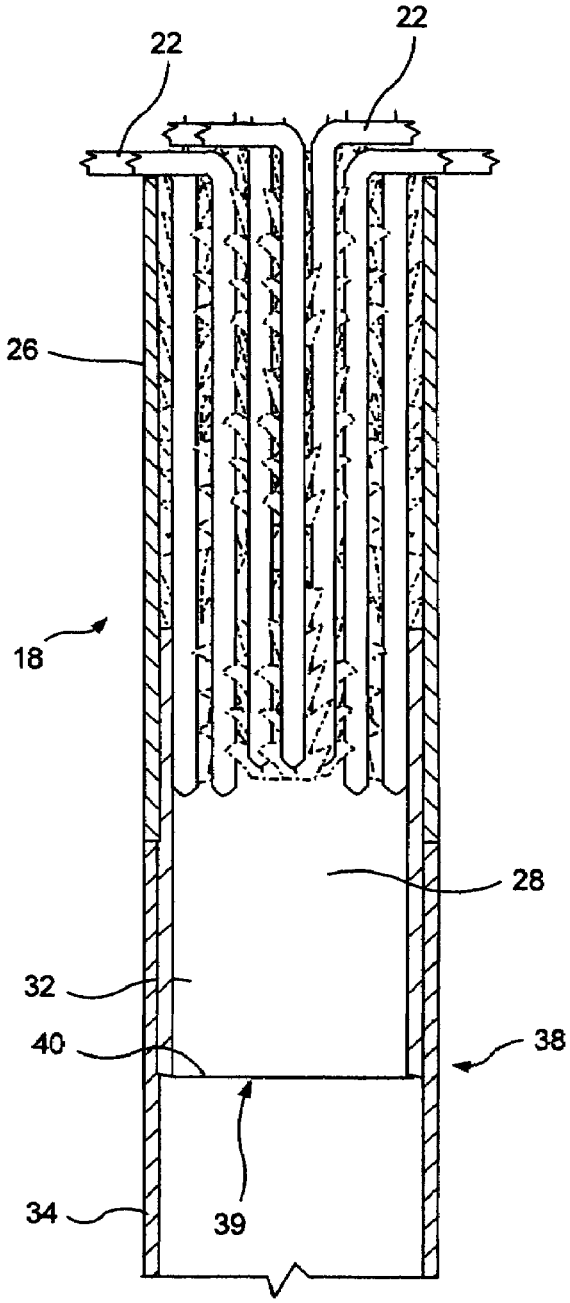
FIG. 6 is a cross-sectional view along line 6-6 of FIG. 3.

The crown element 18 of the palm head 12, as best shown in FIG. 6, comprises an outer shell 26 or outer casing and an inner tube 28 located within the outer shell 26 of the crown element 18. In-this embodiment, the crown element 18, including the outer shell 26 and inner tube 28 are made of metal. However, the crown element 18 may be made of any other such material known in the art such as plastic or wood (See wood sub-embodiment depicted in FIGS. 3A-6A). The inner tube 28 of the crown element 18 has a top end 30 and a bottom end 32.

In forming the palm head 12 of this embodiment, as shown in FIGS. 3-6, each of the metal wire branches 22 with the artificial leaves 24 thereon of the plurality of artificial tree elements 20 are attached around the outer shell 26 of the crown element 18. As shown in FIGS. 3-6, in this embodiment, the branches 22 with artificial leaves are attached around the outer casing 26 of the crown element 18 in the form of substantially an L shape, with one end of each of the branches 22 positioned substantially perpendicular to the outer casing 26 of the crown element and with the other end of each of the branches 22 extending downward along the outer shell 26 of the crown element 18 and substantially parallel thereto. The branches 22 with artificial leaves 24 are preferably secured or adhered to the outer shell 26 of the crown 18 by using adhesives, glue or any other means known in the art. One preferred way of attaching the artificial tree elements 20 to the outer shell 26 of the crown element 18 is by using a machine called an artificial Christmas tree/garland/wreath rayon wrapping machine, which is known in the art. This machine twists or wraps each of the artificial tree elements 20, branch 22 by branch 22 around the outer shell 26 of the crown element 18. The above is but only a preferred way of connecting the branches with palm leaves around crown element 18 in forming the palm head 12 and thus other ways known in the art for forming the palm head 12 may also be used in accordance with the present invention.

The trunk element 14, in this embodiment, is a metal pole, preferably made of steel, which is of sufficient dimensions, e.g. diameter, length, etc. for fitting through an opening 13 in through the top 15 of a desired table 11 for use, in this case, a patio table 11 for installation therein. In this embodiment, the pole 14 is divided into two sections, an upper portion 34 and a lower portion 36. It is noted, however, that the trunk element 14 is not limited to the above description. In this regard, the trunk element 14 may exist as a single piece which is not divided into sections. In sub-embodiments, the trunk element 14 may be divided into more than two sections. Further, in other sub-embodiments, the trunk element 14 may be a pole comprised of other materials besides metal, including but not limited to plastic, wood or a hollowed out wooden tree trunk (See FIGS. 3A-8A for wood sub-embodiments). The trunk element 14 could also be a metal or plastic pole wrapped with brown wood simulation polyvinyl chloride (PVC) material. In addition, in other sub-embodiments, as shown, in FIG. 9, the trunk element 14 could be a metal or plastic pole laminated with plastic material 35 which imitates a type of a tree, such for example, a palm tree. In still further embodiments, a spray on wood simulation chemical could be used to give the trunk element 14 such as a metal pole or plastic pole a more realistic wood look.

The same techniques as mentioned for providing the metal or plastic pole 14 with a more realistic wood look, such as lamination, PVC material wrap, spray on wood simulation may also be applied to the outer shell of the crown element 18 as well. It is further noted that the realistic wood look described above, may be applied to all or only part of the metal or plastic pole 14, outer shell 26 of the crown element 18 and/or base portion 50, as desired.

As shown in FIG. 6, the palm head is connected to the trunk element 14 in this embodiment via an attachment between a bottom area 38 of the crown element 18 and a connection area 40, e.g. insert, within a top end 39 of the upper portion 34 of the trunk element 14. The bottom area 38 of the crown element 18 has an opening therein through which a portion of the inner tube 28 located within the outer shell 26 of the crown element 18 is able to extend through, such that the bottom end 32 of the inner tube is able to slide onto the connection area 40 within the top end 39 of the upper portion 34 of the trunk element 14 for connecting the palm head 12 to the trunk element 14. In addition, the top of the inner tube 28 is open to permit branches to extend outwards therefrom.

Figure 7:
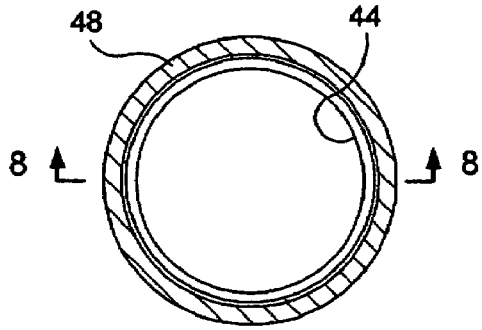
FIG. 7 is a cross-sectional view along line 7-7 of FIG. 2.
Figure 8:
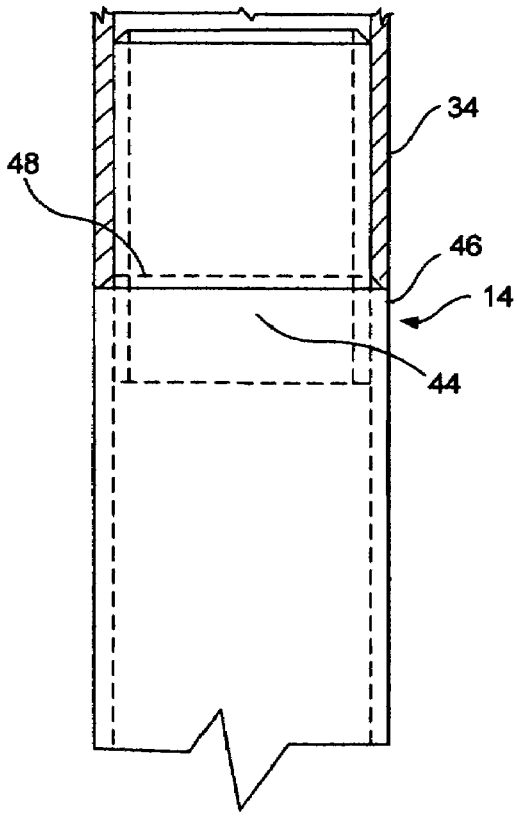
FIG. 8 is a cross-sectional view along line 8-8 of FIG. 7.
Figure 9:
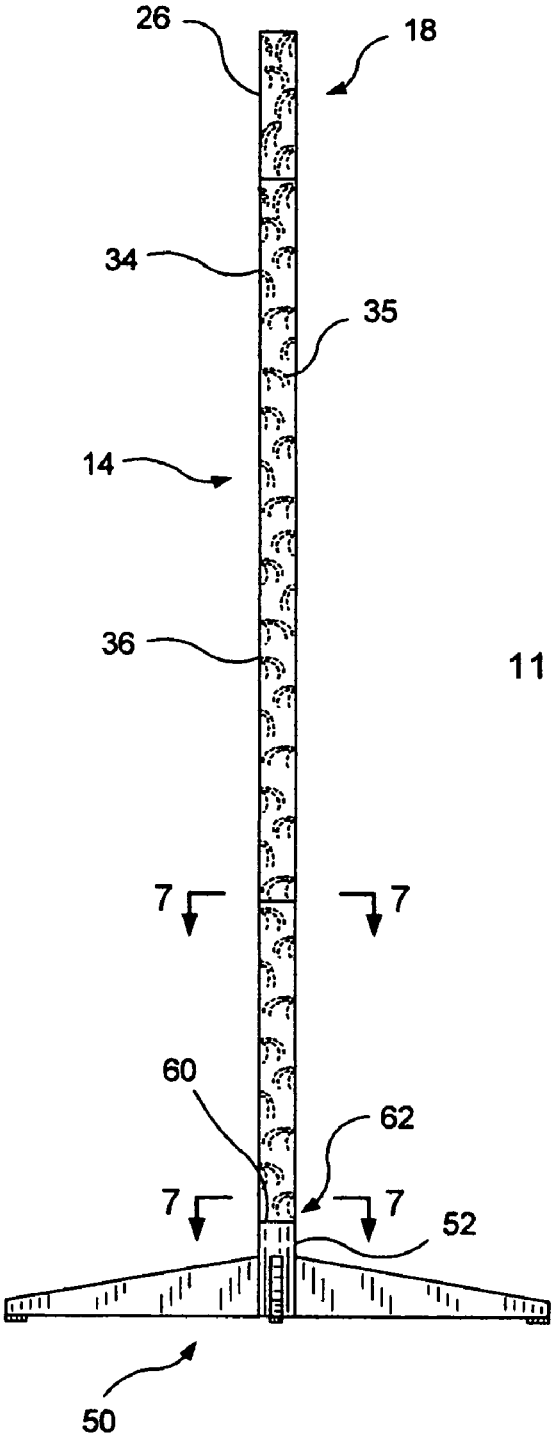
FIG. 9 is a frontal view of the pole and crown element of the artificial palm tree assembly of the first embodiment of the present invention, laminated with plastic material.

Further, as shown in FIGS. 7 and 8, the upper 34 and lower 36 portions of the pole 14, in this embodiment, are connected to one another via a metal insert 44 located within the top end 46 of the lower portion 36 of the pole 14. In connecting the two sections 34, 36 of the pole 14 together, the bottom end 48 of the upper portion 34 of the pole 14, having an opening therein which is placed onto insert 44 located within the top end 46 of the lower portion 36 of the pole 14. In other embodiments, when the trunk element is a plastic pole, then the insert 44, instead of being metal is made of plastic. Moreover, in other embodiments, wherein the trunk element 14 is a wooden pole or hollowed out wooden tree trunk (See FIGS. 3A-8A), then the insert 44 is made of metal.

Figure 10:
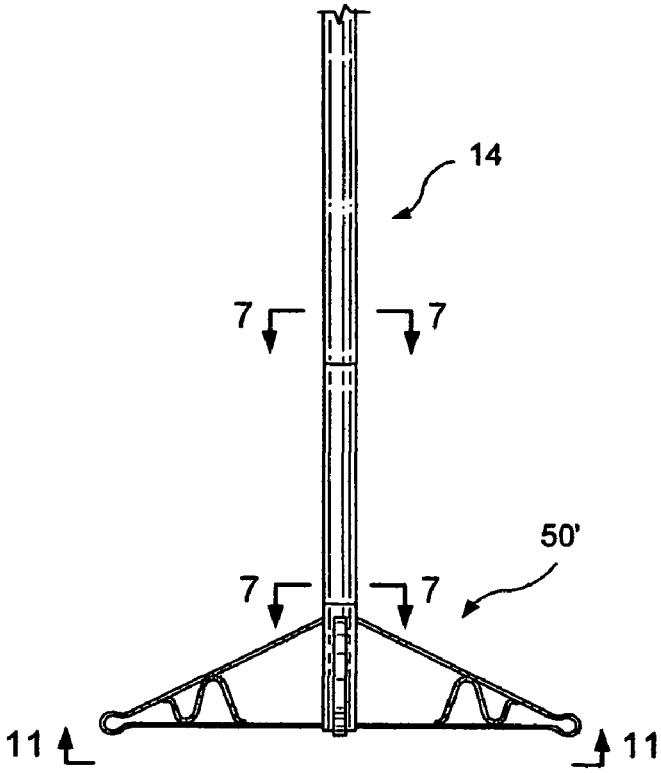
FIG. 10 illustrates another type of base portion which may be used in accordance with the first embodiment of the present invention.
Figure 11:
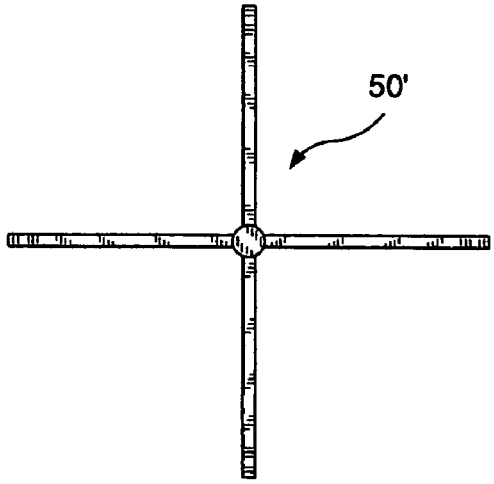
FIG. 11 is a bottom view of the base portion depicted in FIG. 10.

Additionally, as shown in FIGS. 1-2 and 9-11, the artificial palm tree assembly 10 preferably further comprises a base portion 50 or stand. In this embodiment, the base portion 50 is made of metal and comprises an attachment piece 52 protruding upward for connecting to the pole 14 and four legs 53, 54, 55, and 56 for supporting the pole 14 and the palm head 12, of the artificial palm assembly 10. It is noted however that the base portion 50 is not limited to any specific geometric shape or structure. For example, in other embodiments, the base portion may be composed of other materials besides metal, such as plastic or wood (See FIG. 7A for wood sub-embodiment). FIGS. 10-11 illustrate another type of base which may be used in accordance the present invention. The base portion 50 in this first embodiment, is connected to the lower portion 36 of the pole 14 via a metal insert 58 similar to the insert 44 shown in FIGS. 7 and 8, The insert is located within a top end 60 of the attachment piece 52 of the base portion 50.

The base portion 50 is connected to the pole 14 in similar fashion to the way the upper 34 and lower 36 portions of the pole 14 are connected to one another described above and depicted in FIGS. 7 and 8, by placing or sliding the bottom end 62 of the lower portion 36 of the pole 14 onto the insert located within the top end 60 of the attachment piece 52 base portion i.

Figure 2:
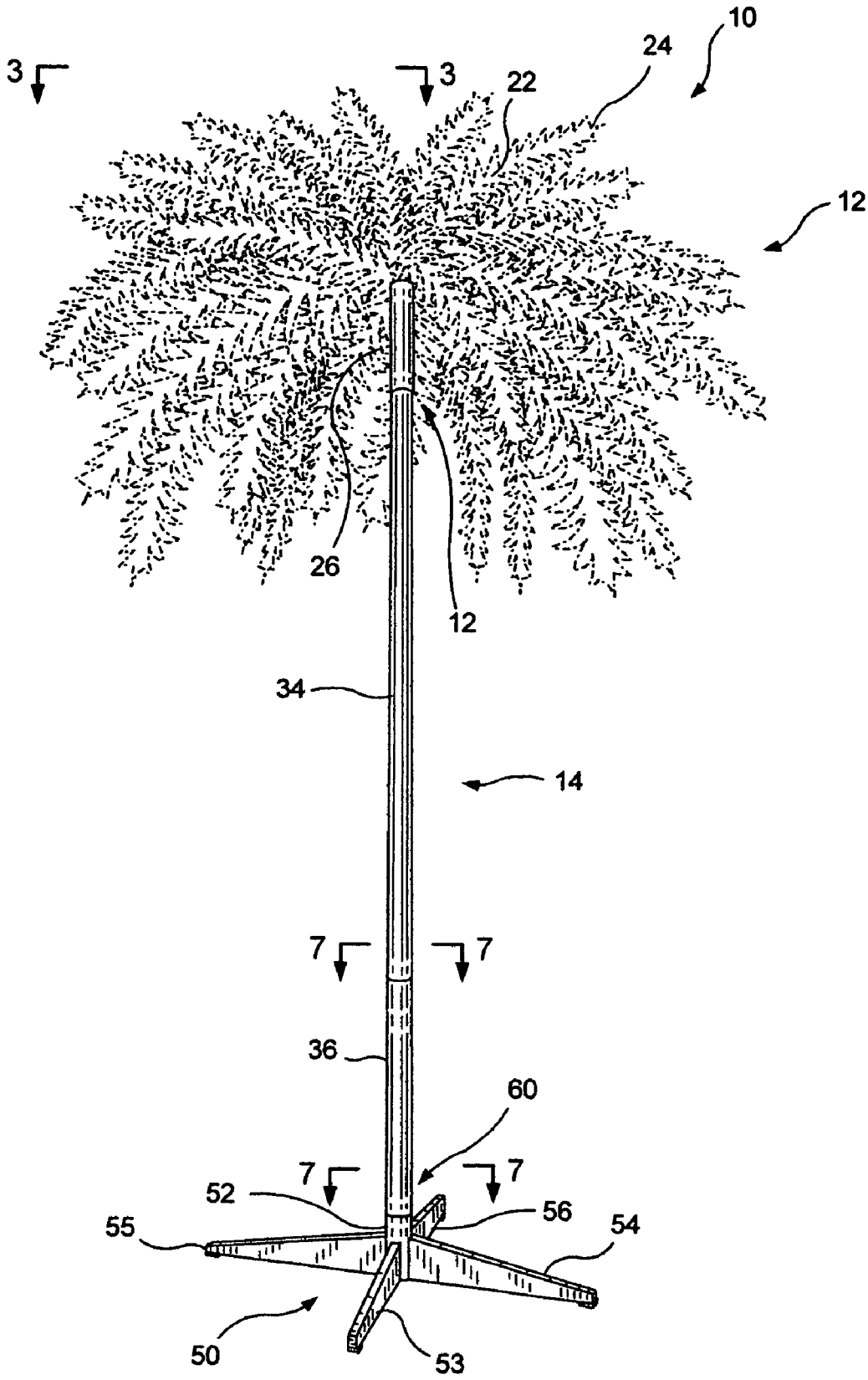
FIG. 2 is a perspective of an artificial palm tree assembly of a first embodiment of the present invention.
Figure 3:
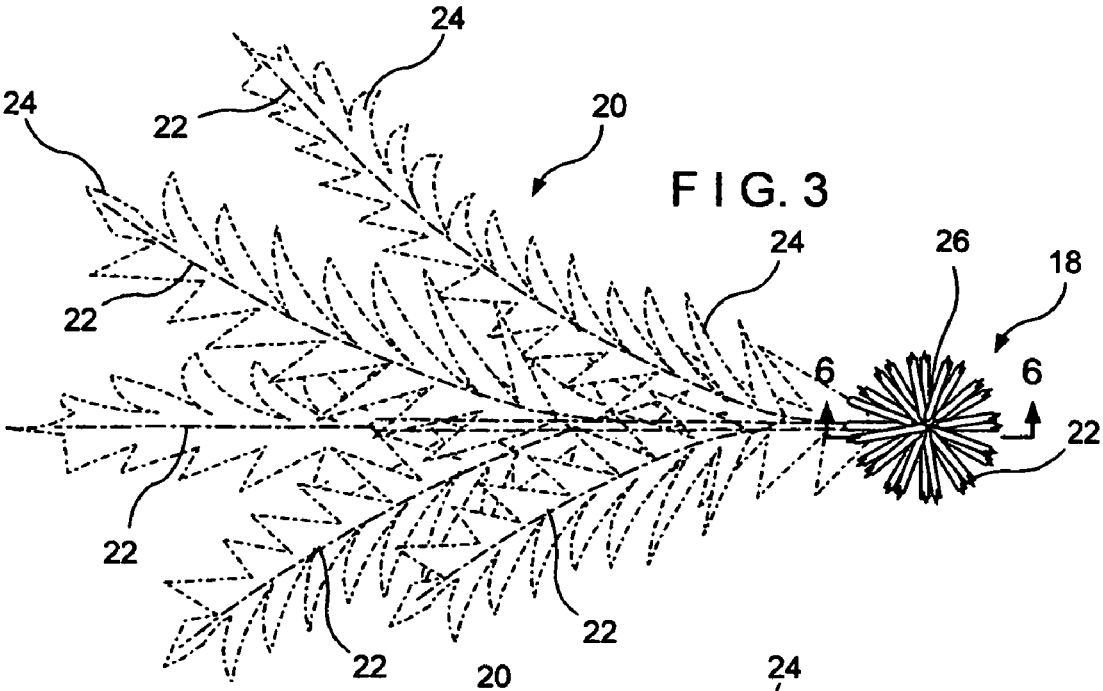
FIG. 3 is a top view (partly cut away) of the palm head of the artificial palm tree assembly of the first embodiment of the present invention depicted in FIG. 1.
Figure 4:
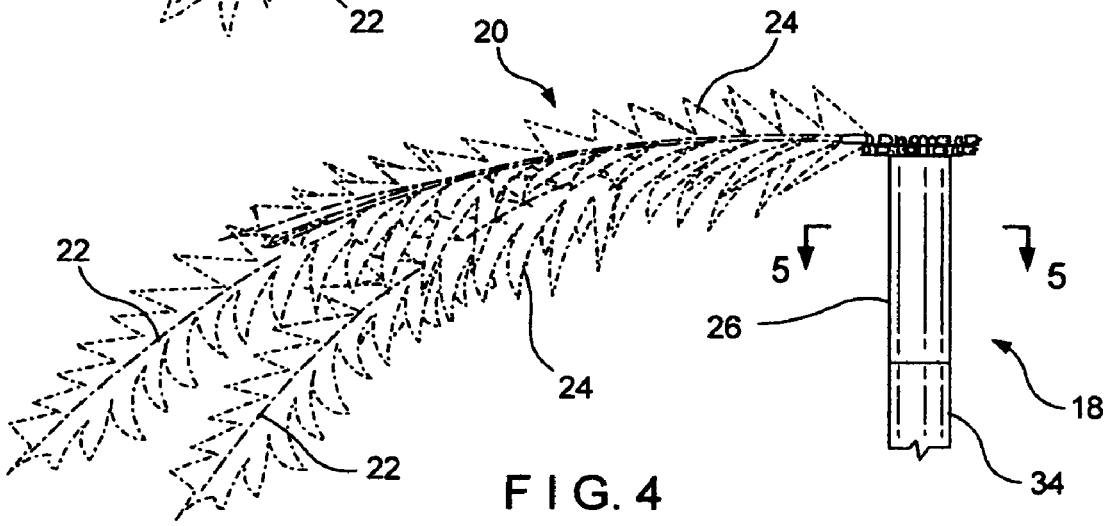
FIG. 4 is a front view of the palm head of the artificial palm tree assembly of the first embodiment of the present invention depicted in FIG. 1.
Figure 5:
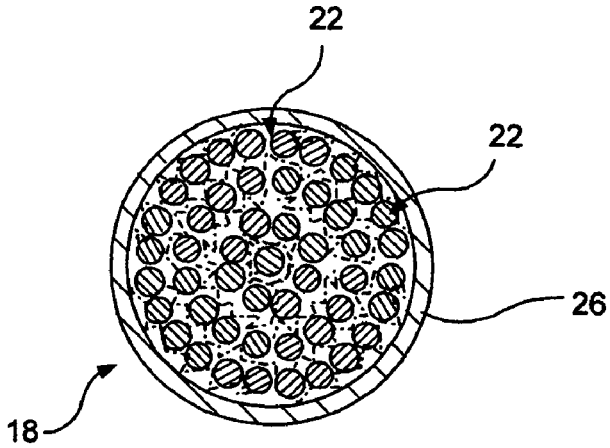
FIG. 5 is a cross-sectional view along line 5-5 of FIG. 4.

FIG. 1 illustrates the artificial palm assembly 10 in assembled form, installed within the patio table and supported by base portion therein. FIG. 2 illustrates the artificial palm assembly 10 in assembled form and supported by the base portion 50 but not yet installed within the patio table 11.

It is noted that the ways to connect the elements of the artificial palm assembly 10 described above, such as connecting the palm head 12 to the pole 14 and connecting the pole sections 34, 36 to one another and connecting the base portion 50 to the pole 14 are by way of example only and are in no way meant to limit the scope of the present invention. Thus, other ways known in the art for making these connections may also be used in accordance with the present invention.

Set forth below is an example of how one would use the artificial palm assembly of the first embodiment of the present invention depicted in FIGS. 1-11. This is meant for illustrative purposes only and is no way meant to limit the scope of practicing the present invention. For example, a user first connects the base portion 50 to the lower portion 36 of the pole 14, in this case a metal pole, by placing or sliding the bottom end 62 of the lower portion 36 of the pole 14 onto the insert located within the top end 60 of the attachment piece 52 of the base portion 50. Next, the user would place a table 11, in this case a patio table over lower portion 36 of the pole 14 which is now connected to the base portion 50 as described above. The user would then align the top end 46 of the lower portion 36 connected to the base portion 50 with the opening 13 in the top 15 of the patio table 11.

The user then would connect the palm head 12 of the artificial palm assembly 10 to the upper portion 34 of the pole 14 by placing the bottom area 38 of the crown element 18 of the palm head 12 onto the top end 39 of the upper portion 34 of the pole 14, such that the bottom end 30 of the inner tube 28 within the outer casing 26 of the crown element 18 slides onto the connection area 40 located within the top end 39 of the upper portion 34 of the pole 14. After, the palm head 12 has been connected to the upper portion of the pole as described, the user then places the bottom end 48 of the upper portion 34 of the pole 14 through the opening 13 in the top 15 of the patio table 11 for connecting the upper portion 34 of the pole to the lower portion 34, which is now located underneath the patio table 11. In connecting the two sections 34, 36 of the pole 14, the bottom end 48 of the upper portion 34 of the pole 14 having an opening therein is placed onto the insert 44 located within the top end 46 of the lower portion 36 of the pole 14, thereby completing installation of the artificial palm assembly within the patio table.

When the user is finished using the artificial palm assembly 10, the user then may disconnect the assembly 10 from the patio table 11 by, for example, first separating the upper pole portion 34 with palm head 12 attachment from the lower portion 36 of the pole by pulling them apart from one another. The user would then lift up the patio table out of contact with the lower pole portion and place the table 11 off to the side.

Figure 12:
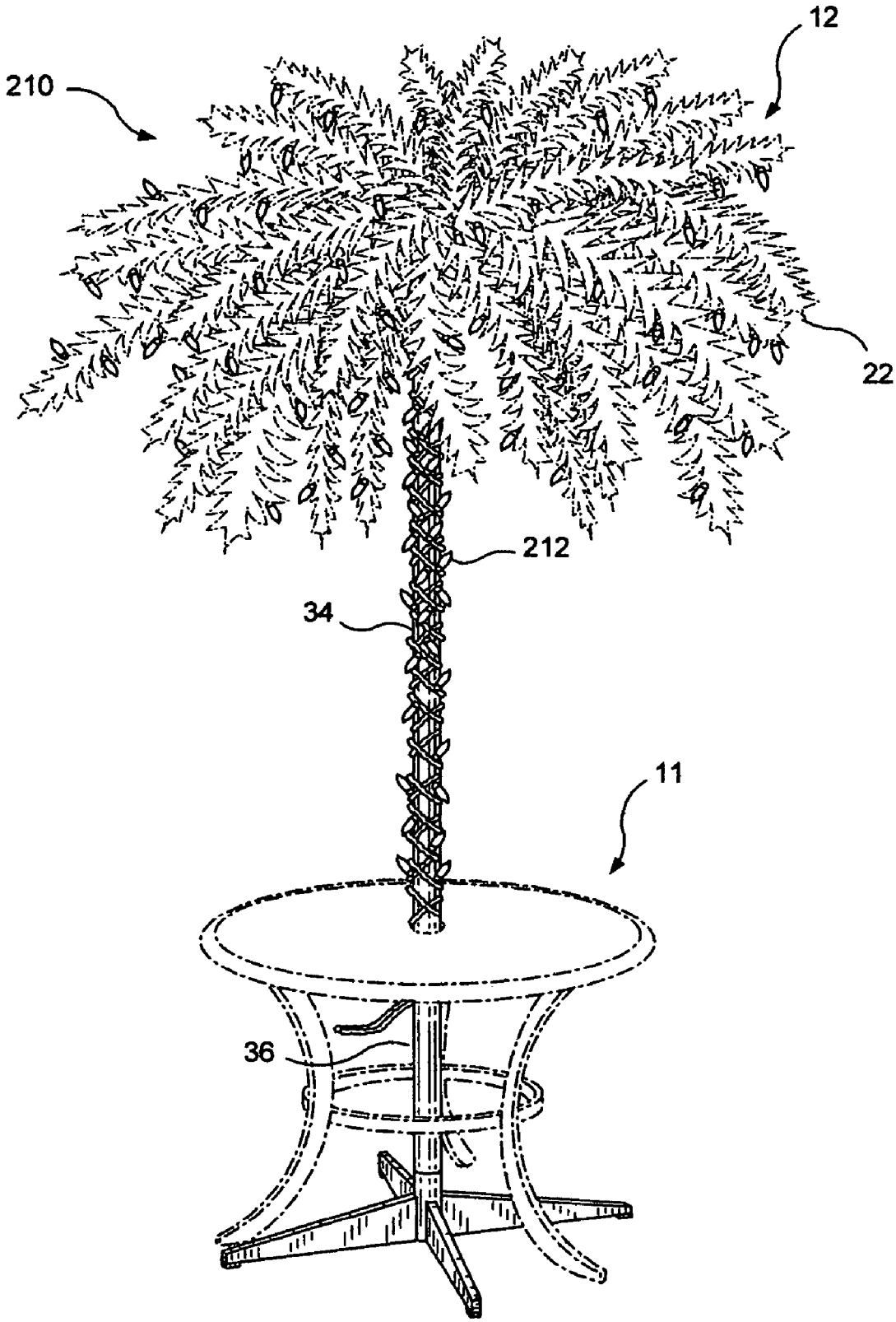
FIG. 12 is a perspective view of an artificial palm tree assembly of a second embodiment of the present invention having decorative lights and installed within a patio table.

FIG. 12 illustrates a second embodiment of the artificial palm tree assembly 210 of the present invention for a patio table 11. This embodiment is essentially the same as and utilized in essentially the same manner as the first embodiment of FIGS. 1-11, with the exception that with this embodiment, there are lights 212 placed around the palm head 12 and around the upper portion 34 of pole 14 of the artificial palm tree assembly 210, above the patio table top 11. Lights 212 such as Christmas tree lights, multicolor lights, clear lights, etc. may be used for decorating the artificial palm tree assembly 212 of this embodiment. Any other lights known in the art may also be used in accordance with the present invention. In other sub-embodiments, lights 212 are only be applied around the palm head 12. In other sub-embodiments, lights 212 are applied around only around the pole 14 of the artificial palm assembly 212, above and below the table. Further, in still other sub-embodiments, lights 212 are applied around the palm head 12 and the pole 14, both above and below the table 11.

FIGS. 13-19 illustrates a third embodiment of the present invention. The artificial palm assembly 310 of this embodiment is essentially the same as and utilized in essentially the same manner as the artificial palm assembly 10 of the first embodiment, except that the patio table 312 in the third embodiment is produced specifically for this palm assembly 310 and are sold together as a unit.

As shown in FIGS. 13-19, the table 312 in this embodiment is preferably a steel mesh patio table, although not limited thereto. In similar fashion to the first embodiment, the top 314 of the steel mesh patio table of the third embodiment 312 has an opening 316 therein adapted to receive a trunk element 320 of the palm assembly there through, such as a pole or trunk which is preferably divided into an upper portion 362 and a lower portion 364. Further, the palm head 318 is connected to the upper portion 362 of the pole 320 in preferably the same manner as described in the first embodiment.

In this embodiment, the pole 320 is preferably further secured within the table 312 by a fastener assembly 322 attached to the mesh table 312, beneath the table 312. The fastener assembly 322 in this embodiment comprises four fasteners 324 and four attachment blocks 328 or structures. Each fastener 324 includes a butterfly twist 332 and a bolt 334. Moreover, as shown in FIGS. 13-19, each of the four attachment blocks 328 are attached on the bottom side of the table 312. Bolts 334 of each of the fasteners 324 extend through an opening in a respective attachment block 328. In addition, four holes 336 are located around the pole for receiving each of the bolts 334 of the fastener 324, such that once the butterfly twists 332 of the fasteners 324 are turned, a corresponding bolt 334 goes through a respective hole 336 in the pole 320 for securing the pole 320 within the opening 316 of the mesh table 312.

Figure 13:
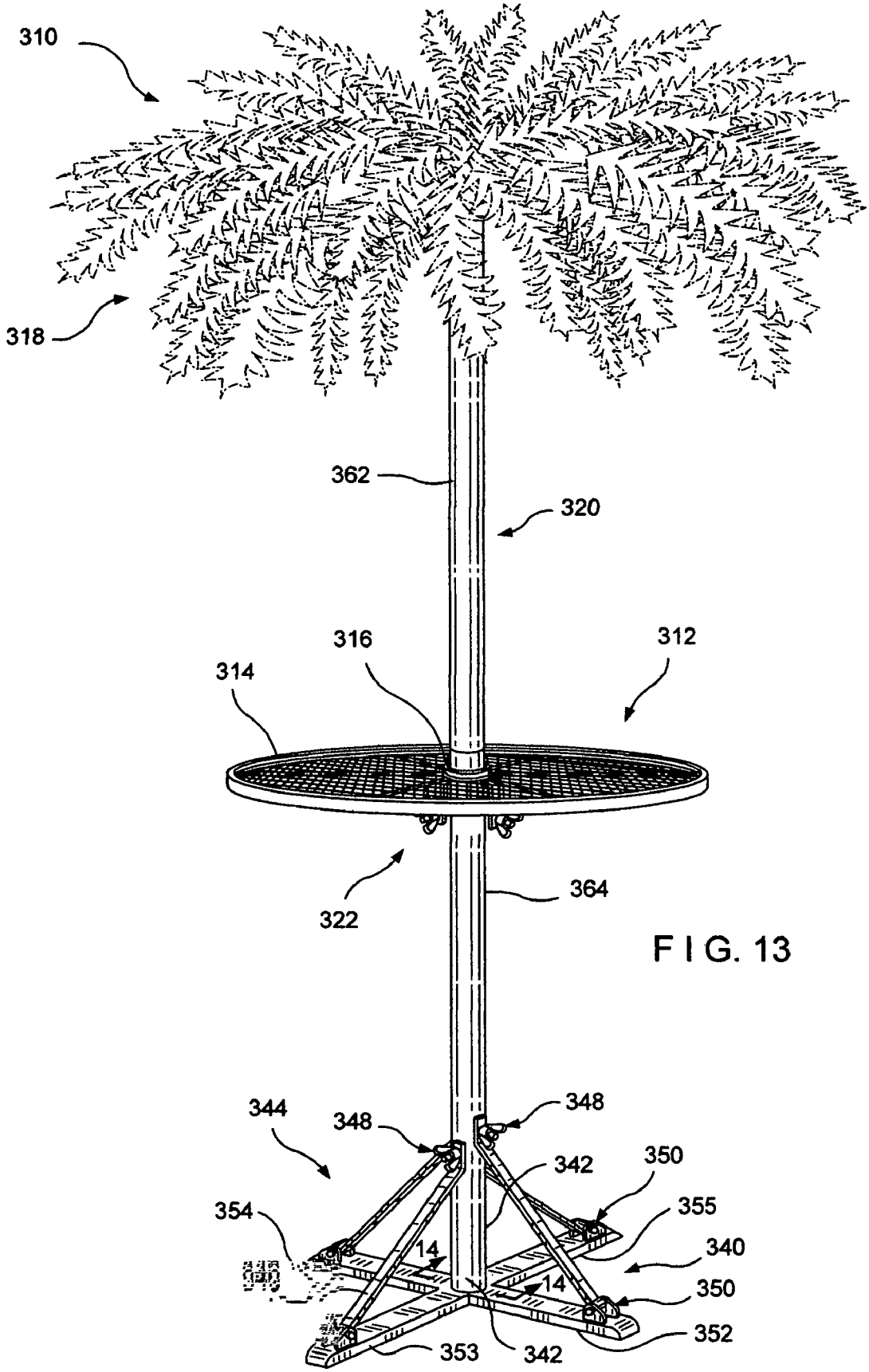
FIG. 13 is a perspective view of an artificial palm tree assembly and patio table set of a third embodiment of the present invention.
Figure 14:
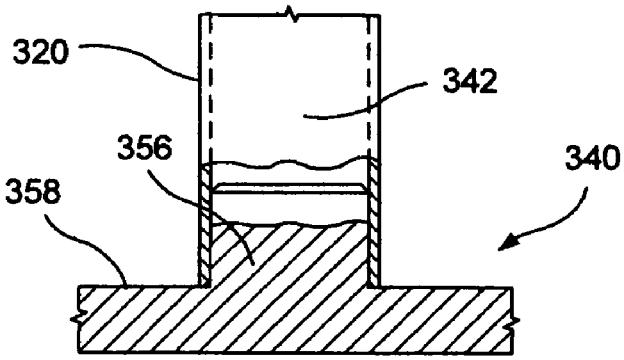
FIG. 14 is a cross-section view along line 14-14 of FIG. 13.
Figure 15:
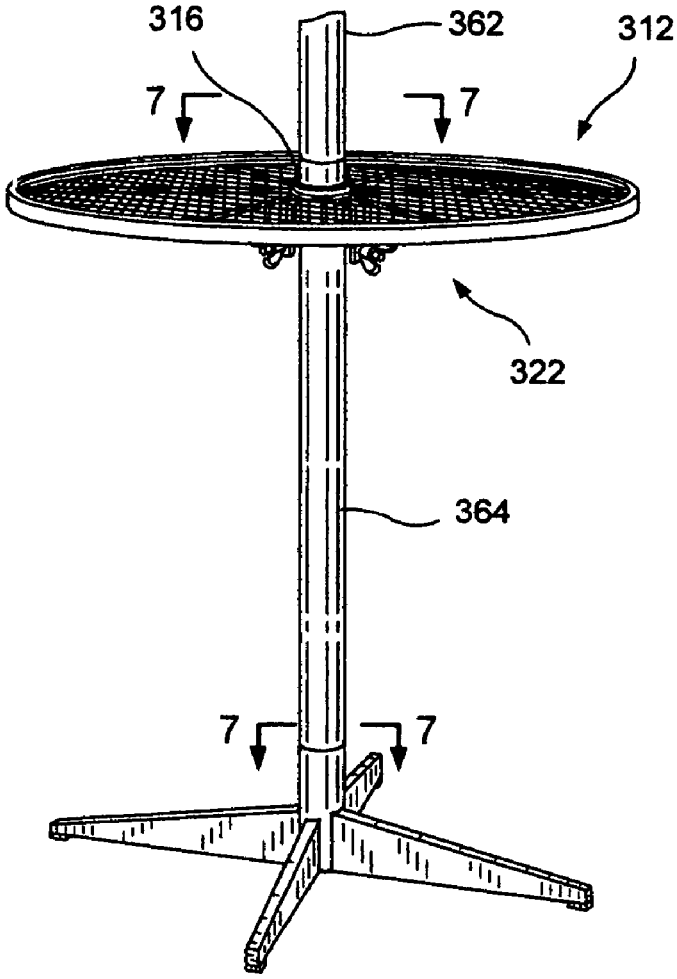
FIG. 15 is a perspective view of the artificial palm tree assembly and patio table set (partly cut away) of the third embodiment of the present invention having another type of base portion.
Figure 16:
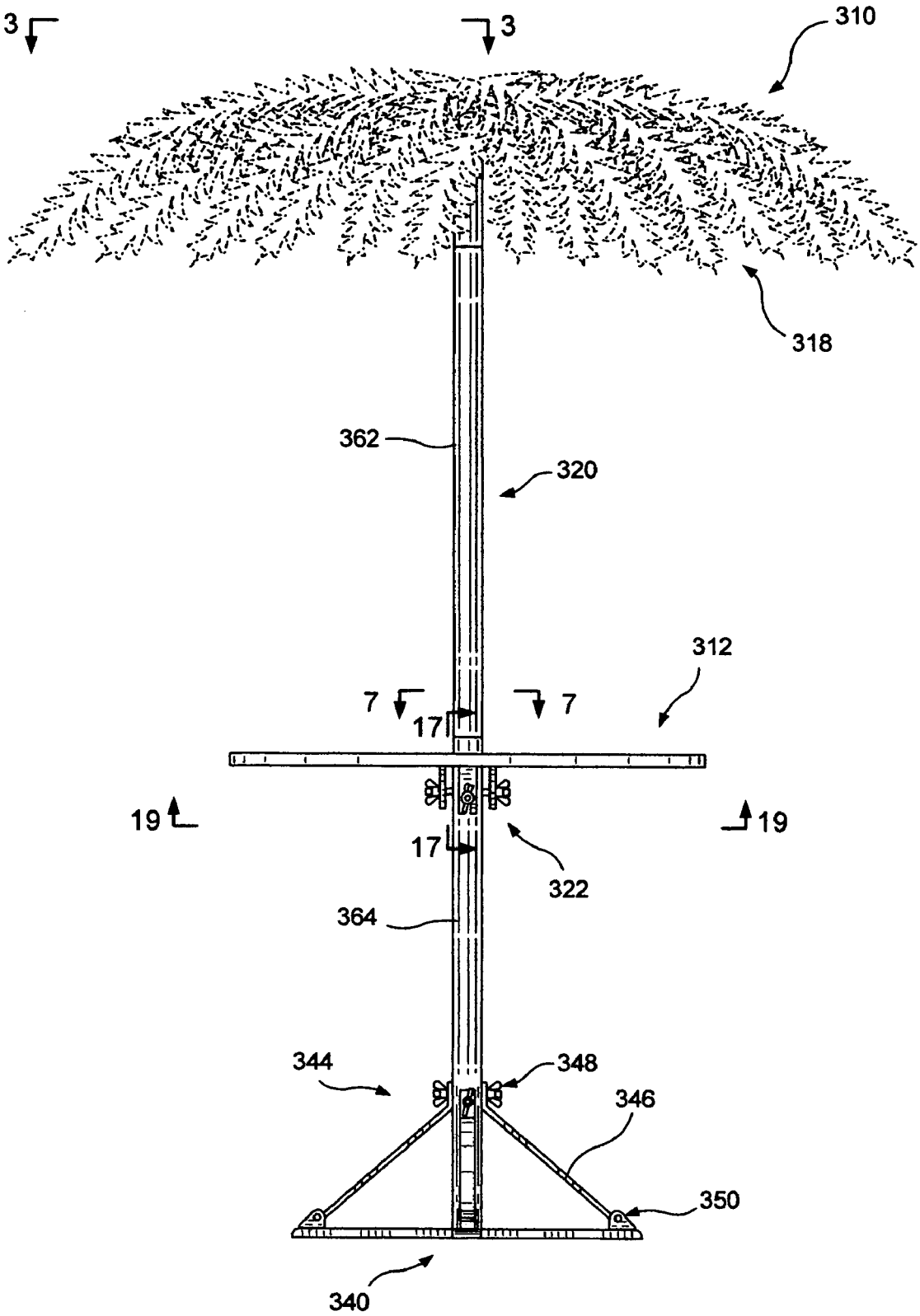
FIG. 16 is a frontal view of the artificial palm tree assembly and patio table set depicted in FIG. 13.
Figure 17:
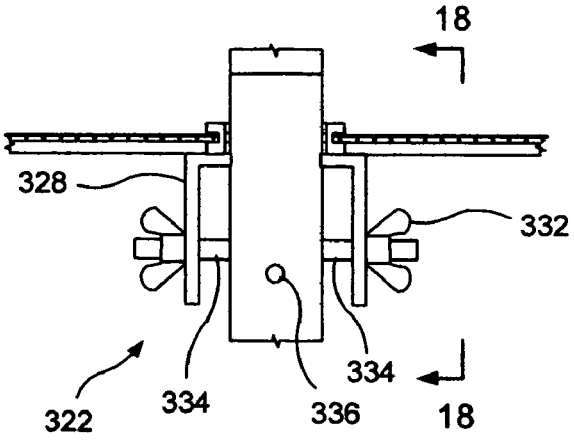
FIG. 17 is a cross-sectional view along line 17-17 of FIG. 16.
Figure 18:
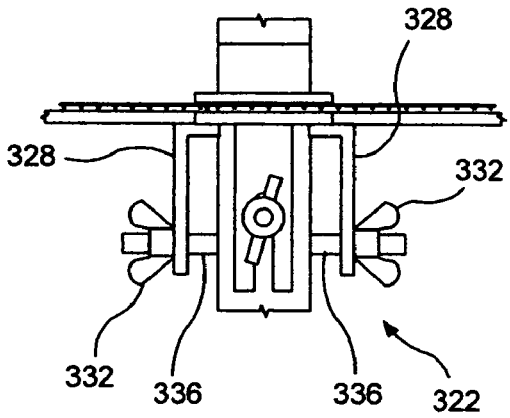
FIG. 18 is a cross-sectional view along line 18-18 of FIG. 17.
Figure 19:
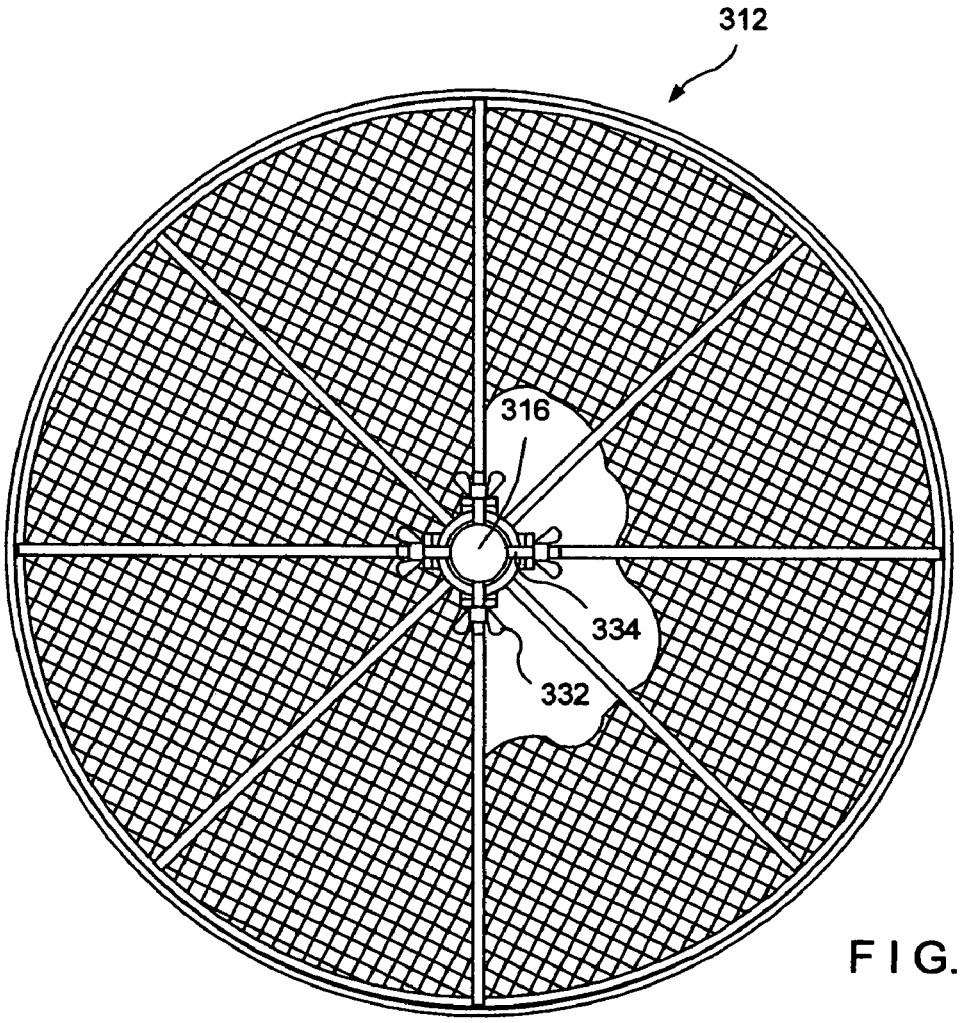
FIG. 19 is a cross-sectional view along line 19-19 of FIG. 16.

Base portion 340 depicted in FIG. 13 is an example of a base portion with may be used in accordance with the third embodiment of the present invention. This base portion 340 is comprised of four metal legs 352, 353, 354, 355 connected together to form a cross shaped base portion 340. As shown in FIGS. 13-14, base portion 340 is connected to the pole 320, via a connection between the bottom end 342 of the pole 320 to an insert 356 located on the top surface 358 of the base portion 340. In addition, a base fastener assembly 344, as shown in FIG. 13, further secures the base portion 340 to the pole 320. The base fastener assembly 344 comprises four rods 346 and 2 sets of fasteners 348, 350. FIG. 15 illustrates another type of base portion 340 which may be used with the artificial palm assembly 310 of the third embodiment. Other base portions such as an umbrella stand in any shape such as but not limited to oval, round, square, etc. and made out of any known materials in the art may be used. As mentioned above, with regard to the previously described embodiments, other types of base portions known in the art may also be used in accordance with the present invention. Alternatively, no base portion is required and the bottom end of the pole 320 can be placed flat on the ground or can be supported by the table through which the pole 320 extends.

Otherwise, as is readily apparent, the installation and use of the artificial palm tree assembly 312 of this embodiment is essentially the same as that of the artificial palm tree assembly 10 described in the first embodiment.

Figure 20:
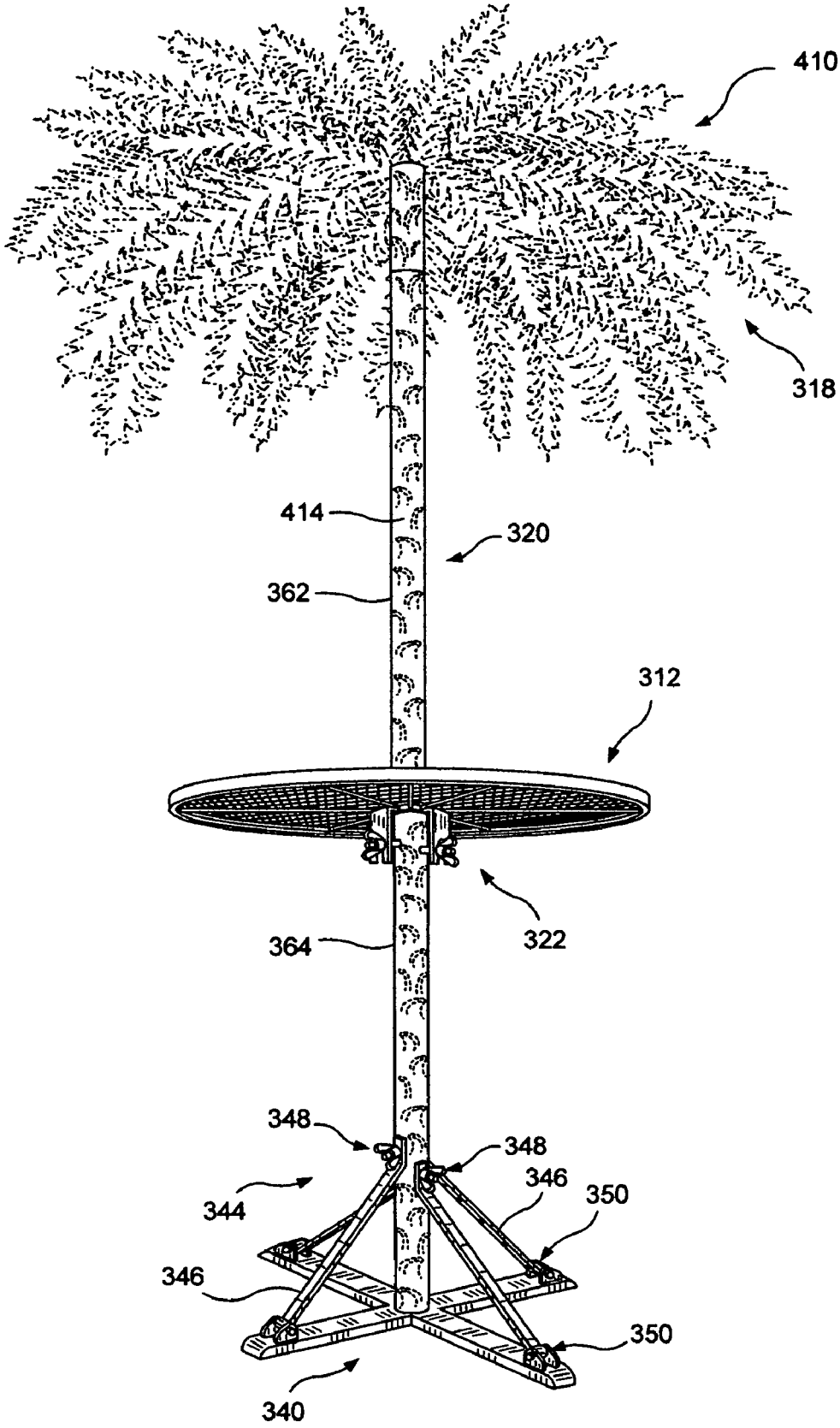
FIG. 20 is a perspective view of an artificial palm tree assembly and patio table set of a fourth embodiment of the present invention, wherein the pole and crown element are laminated with plastic material.
Figure 21:
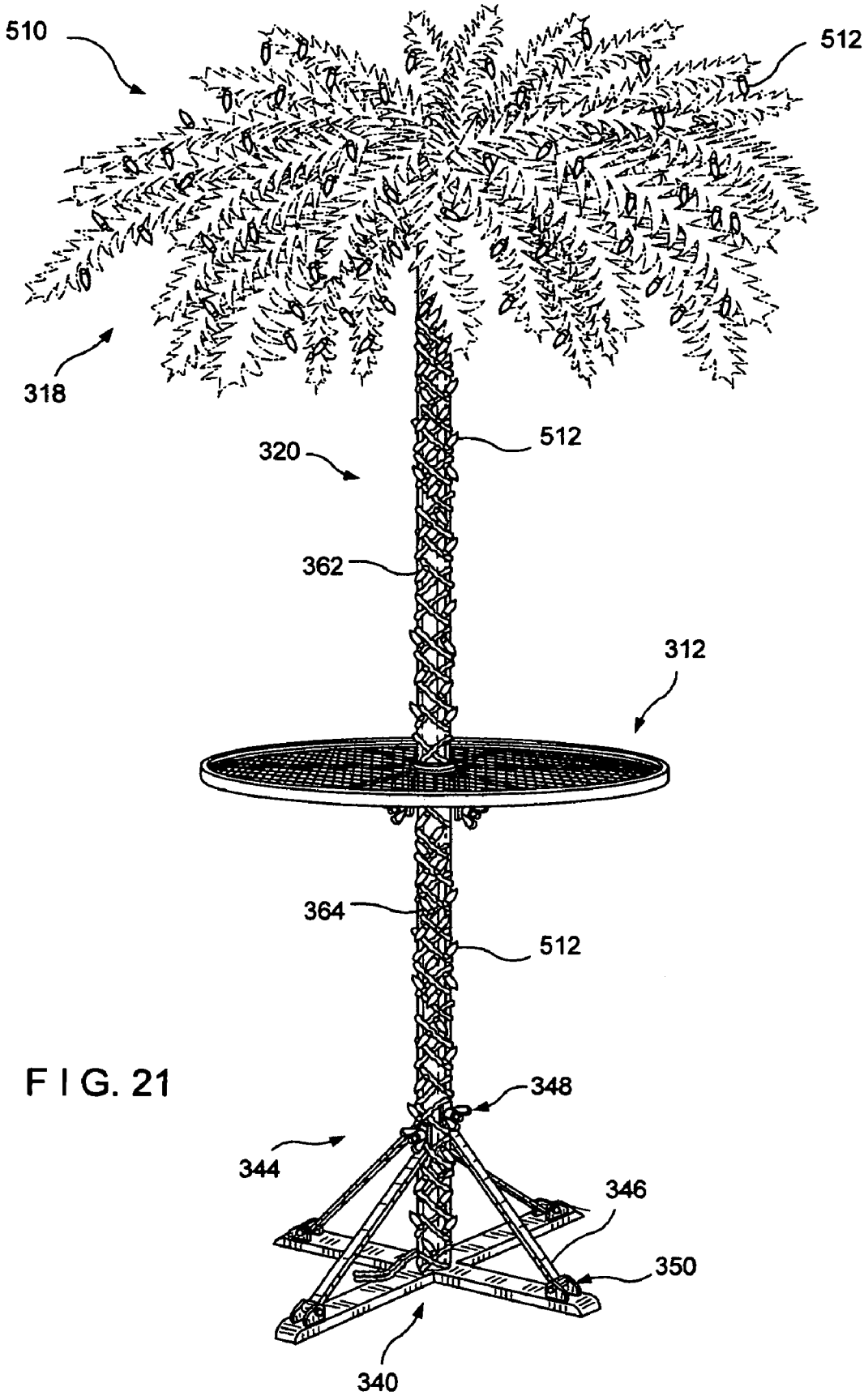
FIG. 21 is a perspective view of an artificial palm tree assembly and patio table set of a fifth embodiment of the present invention, wherein the pole of the artificial palm assembly is wrapped with decorative lights.

FIG. 20 illustrates a fourth embodiment of the artificial palm tree assembly 410 of the present invention for insertion into a table. This embodiment of the present invention is essentially the same as and utilized in essentially the same manner as the artificial palm assembly 310 of the third embodiment, except that in this embodiment, the pole 320 is laminated with plastic material 414 which imitates the tree trunk of a palm tree. In other sub-embodiments, the pole element 320 could be a metal or plastic pole wrapped with brown wood simulation PVC material. FIG. 21 illustrates a fifth embodiment of the artificial palm tree assembly 510 of the present invention for insertion into a table 511. This embodiment of the present invention is essentially the same as and utilized in essentially the same manner as artificial palm assembly 310 of the third embodiment, except that in this embodiment, decorative lights 512, such as Christmas lights surround the palm head 318, and the pole 320, both above and below the table top. Otherwise, the elements and installation of these elements are the same for this embodiment as they are for the third embodiment.

The embodiments described above are not meant to be exclusive. Many other variations of the present invention would be obvious to those skilled in the art, and are contemplated to be within the scope of the appended claims.

The invention claimed is:

1. An artificial palm tree assembly for insertion into a table, comprising:

a palm head comprising a crown element, said crown element comprising an outer casing and a plurality of tree elements attached to said crown element of said palm head, each of said tree elements comprising a branch comprising twisted wires having a plurality of individual artificial palm tree leaves thereon, said branch with said plurality of leaves thereon having an end that is attached around said outer casing of said crown element;

a trunk element for insertion through an opening in a top of a palm tree element; said palm tree element connects to the trunk element via an attachment formed between a bottom area of the crown element and the top end of the trunk element, said crown element further comprises an outer shell and an inner tube, said inner tube is located within said outer casing of the crown element and the bottom area of the crown element comprises an opening through which a portion of the inner tube located within the outer shell of the crown element is able to extend through such that a bottom open end of the inner tube is able to slide onto a connection area located within the top end of the trunk element for connecting the palm head to the trunk element; and each branch with said leaves thereon being attached around said outer casing of said crown element in a substantially L shaped manner with one end of each said branch positioned substantially perpendicular to said outer casing of said crown element and another end of each said branch extending downward along said outer shell of said crown element and being substantially parallel thereto.

2. The artificial palm tree assembly of claim 1, wherein said tree elements are wrapped around the outer casing of the crown element.

3. The artificial palm tree assembly of claim 1, wherein said tree elements that are attached to said outer casing are also wrapped around said outer casing of the crown element and are further secured to the outer shell of the crown element by at least one of an adhesive, glue, or paste.

4. The artificial palm tree assembly of claim 3, wherein said plurality of tree elements further comprises artificial pine needles, said artificial pine needles are mixed with said artificial palm leaves on each side of said branches, said artificial pine needles and said artificial palm leaves are present in a ratio on each of said branches of about 70% artificial pine needles and about 30% artificial palm leaves.

5. The artificial palm tree assembly of claim 1, wherein said branches of said plurality of tree elements are comprised of twisted metal wire and the artificial palm leaves are comprised of polyvinyl chloride.

6. The artificial palm tree assembly of claim 5, wherein each said branch of said plurality of tree element are formed of a pair of twisted metal wires with the artificial palm leaves located thereon.

7. The artificial palm tree assembly of claim 1, wherein said trunk element is comprised of one of the following, a metal pole, a wooden pole, a hollowed out wooden tree trunk.

8. The artificial palm assembly of claim 7, wherein said trunk element is at least one of the following: a metal pole or plastic pole laminated with plastic material thereon which imitates the tree trunk of a palm tree, a metal or plastic pole wrapped with brown wood simulation polyvinyl chloride material thereon, or a metal or plastic pole having a wood simulation chemical sprayed thereon.

9. The artificial palm tree assembly of claim 1, wherein said trunk element is divided into an upper portion having a top end and a bottom end and a lower portion having a top end and bottom end.

10. The artificial palm tree assembly of claim 9, further comprising a base portion for attaching to said bottom end of the lower portion of the trunk element, and wherein said base portion provides support for said palm head and said trunk element of the artificial palm tree assembly installed within said table.

11. The artificial palm tree assembly of claim 9, wherein said bottom end of said upper portion of the trunk element slides onto an insert located within the top end of said lower portion of said trunk element to connect the lower and upper portions to one another.

12. The artificial palm tree assembly of claim 9, wherein said table is a patio table.

13. The artificial palm tree assembly of claim 1, further comprising decorative lights placed upon at least one of the palm head or the trunk element of the artificial palm tree assembly.

14. An artificial palm tree assembly and patio table set, comprising:

a palm head comprising a crown element, said crown element comprising an outer casing and a plurality of tree elements, said crown element comprises an outer shell, a bottom area and an inner tube located with said outer shell of the crown element, said elements are wrapped around the outer casing of the crown element, each of said tree elements comprising a branch comprising twisted metal wires having a plurality of individual artificial palm tree leaves thereon, said branch with said plurality of leaves thereon having an end that is attached around said outer casing of said crown element; each branch with said leaves thereon being attached around said outer casing of said crown element in a substantially L shaped manner with one end of each said branch positioned substantially perpendicular to said outer casing of said crown element and another end of each said branch extending downward along said outer shell of said crown element and being substantially parallel thereto;

a trunk element comprising one of the following: a metal pole, a plastic pole, a wooden pole, a hollowed out wooden tree trunk, said trunk element is divided into at least an upper portion and a lower portion, said upper portion of said trunk element having a top end, said palm head is connected to the trunk element via said inner tube located within the outer shell of the crown element so as to connect and provide a palm head for said trunk element such that a bottom open end of the inner tube is able to slide onto a connection area within the top of the trunk element, said upper portion of the trunk element having a bottom end slidably placed onto an insert located within the top end of said lower portion of said trunk element for connecting the lower and upper portions to one another;

a base portion attached to said bottom end of the lower portion of the trunk element, and wherein said base portion is connected to the lower portion of the trunk element via an open bottom end portion of the lower portion of the trunk element being slidably placed onto an insert located within the top end of the base portion, for connecting the lower and upper portions to one another, said base portion is additionally secured to said lower portion of said trunk element by a plurality of base fasteners; and a patio table having a table top supported by a plurality of legs, said patio table top having an opening therein which receives a portion of said trunk element there through, said patio table further comprising a pole fastener assembly connected thereto beneath the table top for securing said trunk element within said opening of the patio table.

15. The artificial palm tree assembly and patio table set of claim 14, wherein said patio table is a steel mesh patio table and wherein said trunk element is at least one of the following: a metal pole or plastic pole laminated with plastic material thereon which imitates the tree trunk of a palm tree, a metal or plastic pole wrapped with brown wood simulation polyvinyl chloride material thereon, or plastic pole having a wood simulation chemical sprayed thereon.

16. The artificial palm tree assembly and patio table set of claim 14, further comprising decorative lights placed upon at least one of the palm head or the trunk element of the artificial palm tree assembly.

17. A method of installing an artificial palm tree assembly within an opening of a table for providing a decorative effect to a table, comprising:

attaching a bottom area of a crown element of a palm head to a connection area within a top open end of a trunk element for connecting the palm head and trunk element to each other, said palm head comprising said crown element and a plurality of tree elements attached to said crown element of the palm head, each of said tree elements comprising a branch comprising twisted wires having a plurality of individual artificial palm tree leaves thereon;

attaching an end of said branch with said plurality of leaves thereon having an end that is attached around an outer casing, of said crown element; each branch with said leaves thereon being attached around said outer casing of said crown element in a substantially L shaped manner with one end of each said branch positioned substantially perpendicular to said outer casing of said crown element and another end of each said branch extending downward along said outer shell of said crown element and being substantially parallel thereto; and placing a bottom end of the trunk element through said opening within said table.

18. The method of claim 17, wherein a base portion is placed underneath the table prior to placing the bottom end of the trunk element through the opening in said table.

* * * * *